United States Patent [19]

Sakamoto et al.

[11] Patent Number: 5,015,204

[45] Date of Patent: May 14, 1991

[54] MODULAR JACK

[75] Inventors: Yukio Sakamoto; Toshio Hori; Iwao Fukutani; Takeshi Tanabe, all of Nagaokakyo, Japan

[73] Assignee: Murata Manufacturing Co., Ltd., Nagaokakyo, Japan

[21] Appl. No.: 448,300

[22] Filed: Dec. 11, 1989

[30] Foreign Application Priority Data

Dec. 12, 1988 [JP] Japan ..... 63-314806

[51] Int. Cl.[5] ..... H01R 13/66

[52] U.S. Cl. ..... 439/620; 439/676; 336/192

[58] Field of Search ..... 439/620, 660, 78, , 439/676; 336/105, 107, 192, 200

[56] References Cited

U.S. PATENT DOCUMENTS

| | | | |
|---|---|---|---|
| 4,329,665 | 5/1982 | Kawai et al. | 439/620 X |
| 4,602,122 | 7/1986 | Lint | 336/192 X |
| 4,772,224 | 9/1988 | Talend | 439/620 X |
| 4,845,393 | 7/1989 | Burgess et al. | 336/192 X |

FOREIGN PATENT DOCUMENTS 2042342 11/1971 Fed. Rep. of Germany .

*Primary Examiner*—Neil Abrams
*Assistant Examiner*—Khiem Nguyen
*Attorney, Agent, or Firm*—Burns, Doane, Swecker & Mathis

[57] ABSTRACT

A modular jack comprising a built-in common-mode choke coil in which each of two wires of the common-mode choke coil includes its one end comprising a contactor to be put in contact with a counterpart plug and includes the other end comprising a connecting lead to be connected to the printed wiring of a circuit board.

3 Claims, 2 Drawing Sheets

MODULAR JACK

BACKGROUND OF THE INVENTION

1. Field of the Invention

The present invention relates to a modular jack, and more particularly to a modular jack in a modular connector to be employed in an electronic apparatus such as a telephone and a facsimile machine.

2. Description of Related Art

Conventionally in performing countermeasures for suppressing noise using such a device as a modular jack, as illustrated in FIG. 4, a method of providing a three-terminal capacitor 6 on a circuit board 4 (e.g. printed circuit board) on which a modular jack 2 is mounted is adopted, or as illustrated in FIG. 5, a method of providing a common-mode chock coil 8 on a circuit board 4 on which a modular jack 2 is mounted is adopted.

The three-terminal capacitor 6 has a circuit equivalent to that illustrated in FIG. 6 which is designed for grounding noise components. The common-mode chock coil 8 has a circuit equivalent to that illustrated in FIG. 7 which is designed for offsetting noise components of the same phase by providing two coils opposite to each other around an identical core.

However, the method of using the above three-terminal capacitor 6 has a drawback in that the noise elimination effects is degraded when the electronic apparatus is grounded, i.e. the grounding of the capacitor 6 is insufficient. On the other hand, with the method of using the common-mode chock coil 8 there is no problem with regard to insufficient grounding, however, this method has one drawback int hat the electronic apparatus is less compact because the common-mode chock coil 8 occupies a large space (sometimes the space is equal to or more than that occupied by the modular jack 2) on the circuit board 4.

SUMMARY OF THE INVENTION

In view of the above-mentioned problems, the present invention was made to have an object of providing a modular jack that eliminates the problems.

To realize the above object, a modular jack according to the present invention, comprises a built-in common-mode chock coil in which each of two wires of the common-mode chock coil includes its one end comprising a contactor to be put in contact with a counterpart plug and includes the other end comprising a connecting lead to be connected to the printed wiring of a circuit board.

In accordance with the above construction of the modular jack employing a built-in common-mode chock coil, noise components can be effectively eliminated even when the grounding of the electronic apparatus is insufficient in comparison to the conventional modular jack employing the capacitor. In addition to the advantageous feature of the built-in common-mode chock coil, the integration of the wire body with the contactor and the connecting lead necessitates no superfluous space, which leads to a compact design of the modular jack. In other words, the modular jack is advantageous in saving space in comparison with the apparatus employing a separate common-mode chock coil.

The built-in arrangement of the common-mode chock coil is capable of being positioned closer to the contactors, which is advantageous in terms of catching less external noise. The integration of the wire body of the common-mode chock coil with the contactor and the connecting lead can lead to a reduction in the number of parts employed as well as to the elimination of the connecting process such as the soldering process, which is advantageous in improving the product quality and a reduction in the production cost.

BRIEF DESCRIPTION OF THE DRAWINGS

These and other objects and features of the present invention will become apparent form the following description taken in conjunction with the preferred embodiment thereof with the reference of the accompanying drawings, in which.

DETAIL DESCRIPTION OF THE PREFERRED EMBODIMENT

Figure 1:
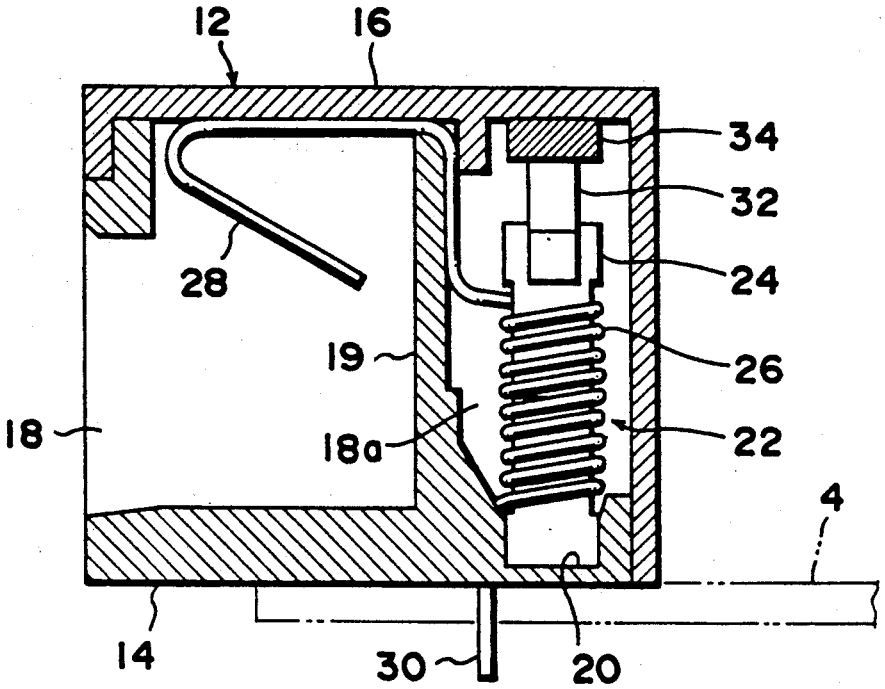
FIG. 1 is an enlarged sectional view of an embodiment of a modular jack according to the present invention.

As illustrated in FIG. 1, a modular jack of the present invention has an insulation housing 12 comprising a base member 14 and a lid member 16 which is fixed to the base member 14 according to a manner such as interlocked coupling, both of which members being made of an insulating material (e.g. molded plastic).

Figure 3:
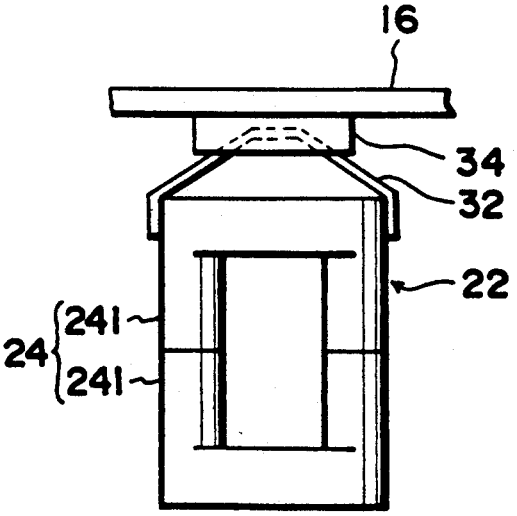
FIG. 3 is a front view of a spring member shown in FIG. 1.

The base member 14 has a separator 19 for defining a chamber 18 which receives a counterpart modular plug in front (the leftward space in FIG. 1) of the separator 19. In the rear chamber 18*a* of the separator 19 is provided one common-mode chock coil 22 for the reason that the embodiment is designed for the two-way circuit. Concretely, the common-mode chock coil 22 is elastically pressed and fixed by a pressure bar spring 32 pressed downward by the lid member 16 while the bottom thereby being engaged with a cavity 20 provided in the base member 14. The bar spring 32 is held at a positioning cavity 34 provided on the lid member 16 to press uniformly both sides of the chock coil 22 (Refer to FIG. 3. The winding of the common-mode chock coil 22, however, is not shown therein).

Figure 2:
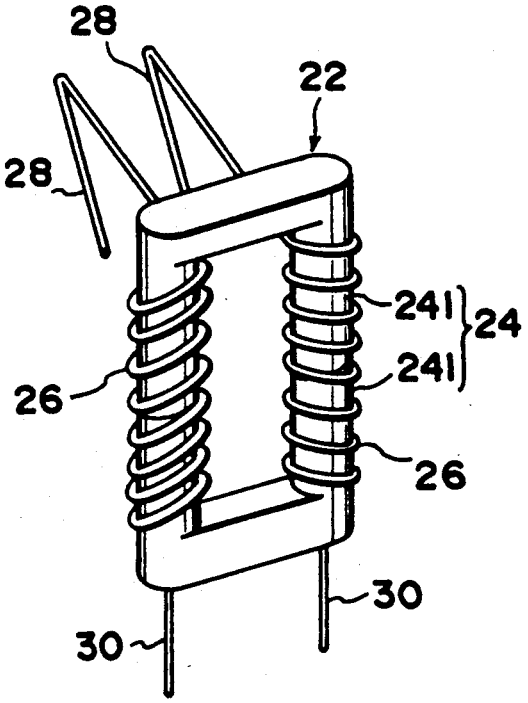
FIG. 2 is a perspective view of a common-mode chock coil shown in FIG. 1.
Figure 7:
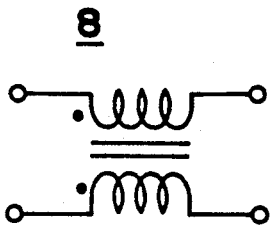
FIG. 7 Prior Art
FIG. 7 is an equivalent circuit of the common-mode chock coil.

As illustrated in FIG. 2, the common-mode chock coil 22 has the construction where a pair of U-shaped core segments 241 are coupled to form a ring-shaped core 24 and a pair of wires 26 are wound separately around two pole portions of the core 24 which have their windings in opposite direction. The equivalent circuit of the coil 22 is the same as that illustrated in FIG. 7.

In the modular jack, one end of each wound wire 26 is extended into the plug receiving chamber 18 as illustrated in FIG. 1 to be formed into a contactor 28 for making an electric contact with the counterpart modular plug (not shown in the drawings). the other end of each wound wire 16 is put through the base member 14 to be formed into a connecting lead 30 for making an electric contact with a wiring of a circuit board 4, etc. In other words, the wound wires 26 of the chock coil 22 are integrated with the contactors 28 and the connecting leads 30.

For achieving the above construction, it is preferred that the wound wires 26 be made of the material having good electric conductivity and elasticity such as a phosphor bronze wire. More specifically, in the embodiment, the wires 26 are phosphor bronze wires coated with an insulating material, while the coat of both ends of the wires 26 are removed and exposed to be formed into the predetermined portions of the wires 26, the contactors 28 and the connecting leads 30. Furthermore, the contactors 28 and the connecting leads 30 are plated with an anti-corrosive material (e.g. gold plating) to protect the portions from possible corrosion such as oxidization.

The modular jack in accordance with the embodiment as illustrated in FIG. 1 is assembled using the above-processed wires 26 according, for example, to the following manner: First, the lower U-shaped core segment 241 is mounted in the cavity 20 of the base member 14; second, the two above-processed wires 26 are wound on the pole portions respectively; third, the upper U-shaped core segment 241 is mounted downward on the lower U-shaped core segment 241; and then the lid member 16 is put in an interlocked coupling with the base member 14 and with the bar spring 32 pressing the upper U-shaped core segment 241. It is noted that the upper and lower U-shaped core segments 241 can be fixed to each other without connecting them using an adhesive or the like.

It is further noted that the process of coating the wires 26 with the insulating material is preferable in terms of protecting the wires 26 against a possible short circuit between them when the distance between the two wires 26 is extremely short. This also means that the coating process may be eliminated in the case where the number of turns of the wire 26 is small or the wires 26 are sufficiently placed apart.

With the above construction, the modular jack of the embodiment effectively eliminates noise components by the operation of the built-in common-mode choke coil 22. More precisely, any common-mode noise components input in both of the two contactors 28 interact to counterbalance each other in the common-mode choke coil 22, therefore the noise components are inhibited from being output to the connecting leads 30.

Figure 4:
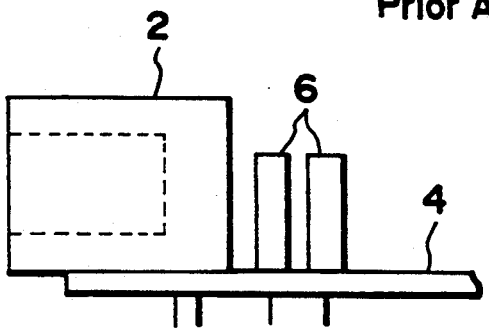
FIG. 4 Prior Art
FIG. 4 is a schematic side view of a circuit board carrying a conventional modular jack and a three-terminal capacitor.

The modular jack of the embodiment has another advantage of causing no interruption on the noise-elimination effect even when the grounding of the electronic apparatus employing the modular jack in insufficient in contrast to the conventional apparatus as illustrated in FIG. 4 where the three-terminal capacitor 6 is employed.

Figure 5:
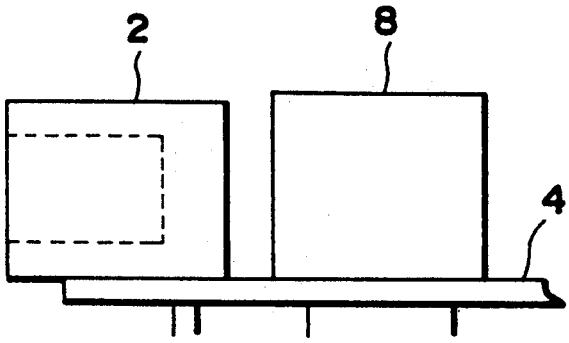
FIG. 5 Prior Art
FIG. 5 is a schematic side view of a circuit board carrying a conventional modular jack and a common-mode chock coil.
Figure 6:
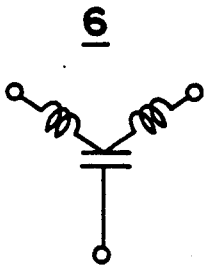
FIG. 6 Prior Art
FIG. 6 is an equivalent circuit of the three-terminal capacitor.

In addition to the above-mentioned advantage of employing the common-mode chock coil 22, the integration of the wire 26 with the contactor 28 and the connecting lead 30 is quite effective in achieving a compact design of the modular jack, because of the elimination of a possible extra space which would otherwise be required. In other words, the above-mentioned arrangement necessitates no extra-space as required by the conventional example in FIG. 5 where the common-mode choke coil 8 is provided separately from the modular jack 2, which also enables the compact design of the electronic apparatus employing the modular jack.

Furthermore, when the modular jack 2 is provided separately from the three-terminal capacitor 6 or the common-mode choke coil 8 as shown in the conventional example, the line between the two parts is comparatively elongated to inadvertently serve as an antenna for catching external noise in terms of the fact that eh contactors of the modular jack 2 are exposed out of the electronic apparatus. In contrast to the disadvantage of the conventional apparatus, the modular jack of the embodiment can provided the effect of reducing the influence from external noise because the built-in common-mode chock coil 22 is placed sufficiently close to the contactors 28.

The integration of the wire 26 of the common-mode chock coil 22 with the contactor 28 and the connecting lead 30 in the modular jack of the embodiment requires a smaller number of parts, which leads to effective prevention of producing defective products attributable to possible processing error as well as to a reduction in time for the processing and a reduction in cost.

The integration of the wire 26, the contactor 28 and the connecting lead 30 requires no soldering process and no cleaning of the flux used in the soldering process, which also leads to an improvement in the quality and a cost reduction of the final product.

Although the present invention has described in connection with the preferred embodiment thereof, it is to be noted that various changes and modifications are apparent to those skilled in the art. Such changes and modifications are to be understood as included within the scope of the present invention as defined by the appended claims, unless they depart therefrom.

For example, the above-mentioned embodiment employs a single common-mode chock coil 22 because it is used for the two-way circuit, a plurality of common-mode choke coils 22 may be employed corresponding to the number of circuit ways to which the modular jack is applied. In such a case, the insulation housing 12 in FIG. 1 can be extended rearward (toward the right side in FIG. 1), and additional common-mode choke coils 22 can be provided at the rear of the common-mode choke coil 22 illustrated.

The ring-shaped core 24 of the common-mode choke coil 22, which is composed of the two U-shaped core segments 241, may be composed of one U-shaped core segment and one I-shaped core segment.

It is further noted that the fixation means of the common-mode choke coil 22 in the insulation housing 12;, the mounting direction of the modular jack on the circuit board 4, etc., and the drawing direction of the connecting leads 30, etc. are not limited to the manner as described for the above embodiment.

What is claimed is:

1. A modular jack for mounting on a circuit board, said modular jack comprising:

a common-mode choke coil in which two wires are separately wound around a ring-shaped core in opposite directions, each of said wires having an end terminating as a contactor to be put in contact with a plug and an end terminating as a lead which provides direct electrical connection of the common-mode choke coil with a printed wiring of said circuit board; and a housing for housing said common mode choke coil, which housing is made of insulating material.

2. A modular jack as claimed in claim 1, further including a separator for dividing said housing into two chamber, in one of said chambers said common-mode choke coil is mounted and into the other of said chambers said contactors of the wires are extended, and said leads of the wires are protruded from the housing.

3. A modular jack as claimed in claim 1, in which said core comprises a pair of U-shaped core segments.

* * * * *